United States Patent [19]

Kuehnel

[11] Patent Number: 4,789,998

[45] Date of Patent: Dec. 6, 1988

[54] MEDIUM FREQUENCY X-RAY DIAGNOSTICS GENERATOR POWER CONTROL

[75] Inventor: Werner Kuehnel, Uttenreuth, Fed. Rep. of Germany

[73] Assignee: Siemens Aktiengesellschaft, Berlin and Munich, Fed. Rep. of Germany

[21] Appl. No.: 9,452

[22] Filed: Feb. 2, 1987

[30] Foreign Application Priority Data

Mar. 27, 1986 [DE] Fed. Rep. of Germany ..... 3610438

[51] Int. Cl.[4] ..... H05G 1/10; H05G 1/34; H05G 1/50

[52] U.S. Cl. ..... 378/110; 378/102

[58] Field of Search ..... 378/102, 109, 110; 363/142

[56] References Cited

U.S. PATENT DOCUMENTS

| | | | |
|---|---|---|---|
| 3,325,645 | 6/1967 | Splain | 378/110 |
| 3,863,140 | 1/1975 | Easter et al. | 323/288 |
| 4,039,811 | 8/1977 | Ennslin et al | 378/112 |
| 4,520,494 | 5/1985 | Arita et al. | 378/108 |

FOREIGN PATENT DOCUMENTS

| | | |
|---|---|---|
| 0096843 | 12/1983 | European Pat. Off. . |
| 0146875 | 7/1985 | European Pat. Off. . |
| 2443709 | 3/1976 | Fed. Rep. of Germany . |
| WO82/00397 | 2/1982 | PCT Int'l Appl. . |

*Primary Examiner*—Eugene R. Laroche
*Assistant Examiner*—David Mis
*Attorney, Agent, or Firm*—Hill, Van Santen, Steadman & Simpson

[57] ABSTRACT

A circuit for controlling a medium frequency x-ray diagnostics generator, the generator having a power rectifier connected to a main power source having an unknown internal resistance. A low-voltage filter stage, and inverter, a high-voltage transformer, and a high-voltage rectifier are connected in sequence between the power rectifier and an x-ray tube. A control unit for the x-ray tube is provided which controls the x-ray tube input current dependent upon the input voltage to the inverter, so that the x-ray tube voltage is maintained constant independently of the internal network resistance of the main. The generator can thus be connected to different mains having different internal resistances without affecting operation of the x-ray tube, making the generator suitable for use as a portable generator. A capacitance connected in the generator preceding the inverter, such as in the low-voltage filter stage, insures that the inverter input voltage will change more slowly than a rate at which the x-ray tube current can be changed.

5 Claims, 2 Drawing Sheets

MEDIUM FREQUENCY X-RAY DIAGNOSTICS GENERATOR POWER CONTROL

BACKGROUND OF THE INVENTION

1. Field of the Invention

The present invention relates to a medium frequency x-ray generator, and in particular to a portable medium frequency x-ray generator.

2. Description of the Prior Art

In an x-ray diagnostics generator, the maximum power of the tube depends upon the internal resistance seen by the x-ray tube, which includes the internal resistance of the generator itself as well as the internal resistance of the power supply. For stationary generators, the value of the internal resistance can be easily determined because the generator is always connected to the same power source, and thus the internal resistance of the power source will not vary, i.e., the power source internal resistance is known. The maximum x-ray tube power can then be adjusted dependent upon this fixed internal resistance.

For portable x-ray diagnostics generators, in contrast, the internal network resistance may differ from plug to plug. If the x-ray tube power is matched to a highest occurring internal network resistance, the exposure time will be unnecessarily long when the generator is connected to networks having a lower internal resistance, because the x-ray tube current could be higher in such cases than when the generator is connected to a highest internal network resistance. If one generally employs a high x-ray tube power, the x-ray tube voltage may fall in an undesired manner when the generator is connected to poor networks.

SUMMARY OF THE INVENTION

It is an object of the present invention to provide a medium frequency x-ray diagnostics generator wherein the x-ray tube voltage is maintained constant at a predetermined value independently of the internal network resistance of the supply source to which the generator is connected.

The above object is achieved in accordance with the principles of the present invention in an x-ray diagnostics generator having a control unit for controlling the x-ray tube current based on the input voltage to an inverter in the generator. The current is controlled so that the x-ray tube voltage is roughly constant independently of the internal network resistance of the power source. The input voltage of the inverter will be diminished upon loading of the inverter, the amount of the diminution being dependent upon the internal network resistance. Accordingly, the inverter input voltage can be used for controlling the x-ray tube current, and thus the x-ray tube power by maintaining the x-ray tube voltage at a constant value. This type of generator is thus suited for use as a portable generator wherein the internal network resistance of the power source to which the generator is to be connected is unknown. As used herein, the term "unknown" means that the internal network resistance is not known in advance. Once a plug for the generator is selected, the internal network resistance associated with the plug can obviously be measured or calculated, however, it is not known in advance to which plug a portable x-ray generator may be connected, and in this sense the internal network resistance is unknown.

DESCRIPTION OF THE PREFERRED EMBODIMENTS

Figure 1:
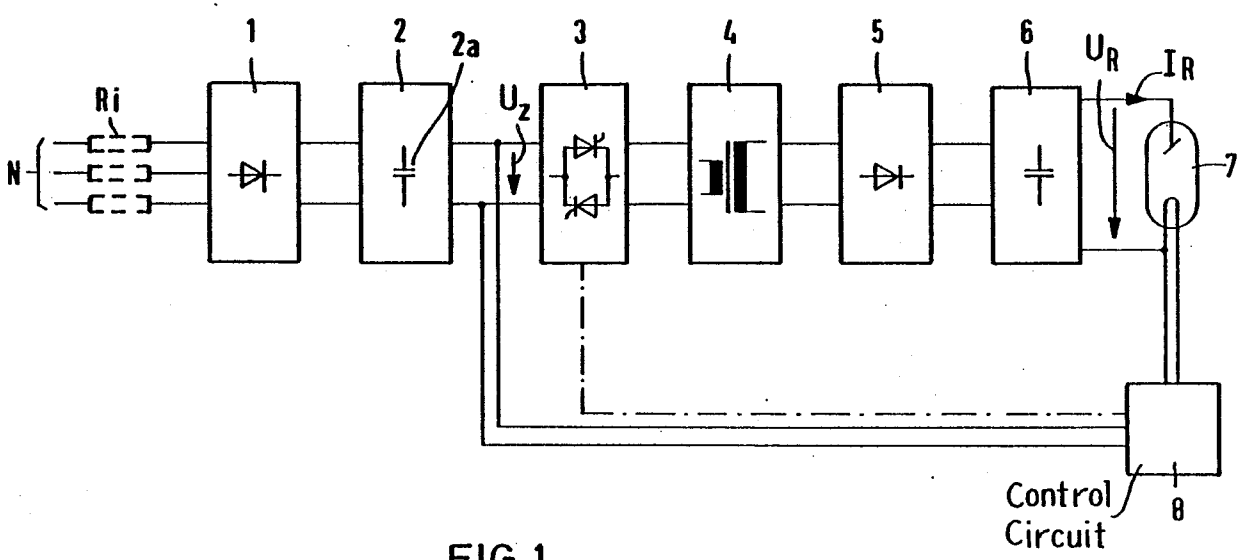
FIG. 1 is a schematic block diagram of a medium frequency x-ray diagnostics generator constructed in accordance with the principles of the present invention.

The medium frequency x-ray diagnostics generator shown in FIG. 1 has a power rectifier 1 followed in sequence by an intermediate filter stage 2 having a capacitance 2*a*, and inverter 3, a high-voltage transformer 4, a high-voltage rectifier 5, a high-voltage filter stage 6, and an x-ray tube 7. The x-ray tube 7 is supplied with filament current from a control circuit 8. The power rectifier 1 is connected to a network N of unknown internal resistance Ri.

Before the beginning of an x-ray exposure, the capacitance 2*a* in the intermediate filter stage 2 is charged to its maximum value dependent on the main voltage. The internal network resistance Ri is not yet a factor because the load has not yet been added. At the beginning of an exposure with maximum x-ray tube power, the capacitance 2*a* is discharged to a steady state value which is dependent on the x-ray tube power, on the main voltage, and on the internal network resistance Ri.

If, for example, the internal network resistance Ri is too large, or the main voltage is too low for the maximum x-ray tube power which has been set, the steady state value of the inverter input voltage $U_z$ will be too low under certain conditions. The graphs of FIGS. 2 through 5 respectively show curves in dashed lines labeled "a" for the inverter input voltage $U_z$ the inverter drive frequency $f_A$, the x-ray tube current $I_R$, and the x-ray tube voltage $U_R$, with respect to time t, under such circumstances.

In the generator shown in FIG. 1, to correct this problem, the x-ray tube power after the beginning of an exposure is lowered by the control circuit 8. This is accomplished by lowering the x-ray tube current $I_R$. The x-ray tube current $I_R$ is lowered to such a degree that the undesirable case is avoided. Accordingly, the shortest possible exposure time is obtained for every internal network resistance Ri, and the x-ray tube voltage $U_R$ is maintained at its nominal value. These relationships are shown in FIGS. 2 through 5 by the solid-line curves labeled "b".

Lowering of the x-ray tube current $I_R$ is controlled by the current value of the voltage $U_z$ at the output of the intermediate filter stage 2 (or at the input of the inverter 3). As indicated by the dot-dash line in FIG. 1, the x-ray tube current $I_R$ may also be controlled by the current value drive frequency $f_A$, which will always assume a maximum value when the voltage $U_z$ has dropped to the permissible minimum value.

The capacitance 2*a* in the intermediate filter stage 2 is dimensioned such that lowering of the voltage $U_z$ occurs more slowly than the rate at which the x-ray tube current $I_R$ can be reduced.

As stated above, the circuitry for the generator disclosed herein is suited for portable x-ray generators, however, the generator disclosed herein may be used as a stationary x-ray generator as well for the purpose of achieving the shortest possible exposure time.

Even given high-impedance networks, it is possible at the beginning of the exposure time to work with a higher tube current in a stationary generator.

Figure 2:
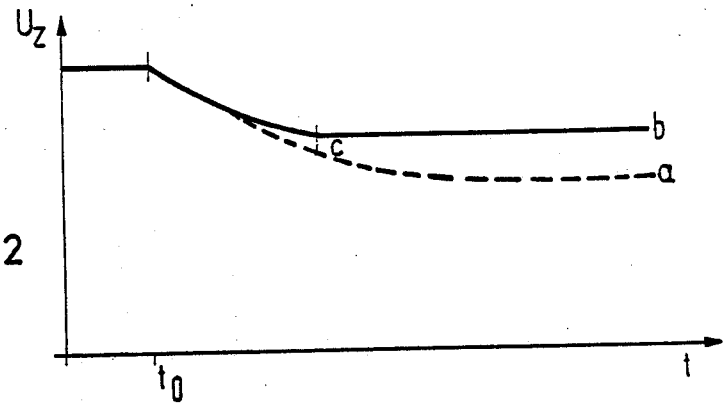
FIGS. 2 through 5 are curves showing various parameters of the generator of FIG. 1 during operation over time.
Figure 3:
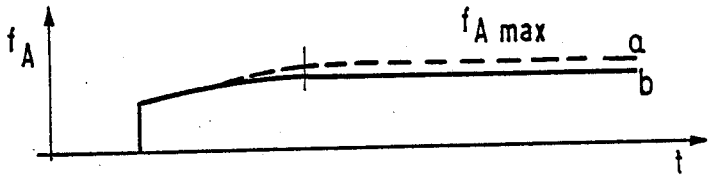
Figure 4:
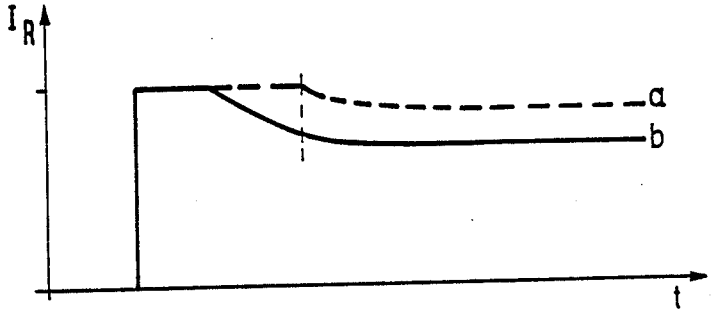
Figure 5:
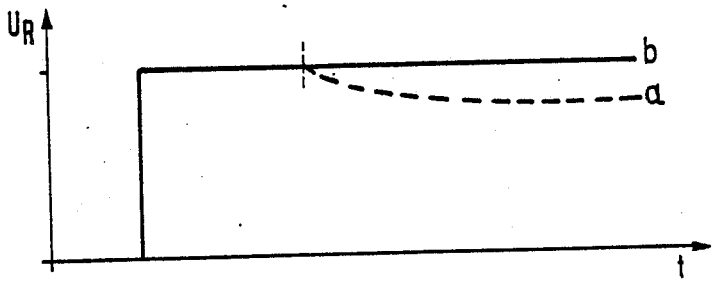

The increase in the inverse rectifier input voltage which occurs when the current $I_R$ is lowered is shown at C in FIG. 2. The beginning of exposure occurs at a point in time $t_0$.

Although modifications and changes may be suggested by those skilled in the art it is the intention of the inventor to embody within the patent warranted hereon all changes and modifications as reasonably and properly come within the scope of his contribution to the art.

I claim as my invention:

1. A medium frequency x-ray generator comprising:

an x-ray tube;

means connecting said x-ray tube to a power source having an unknown internal network resistance; and control means including an inverter connected between said x-ray tube and said power source for controlling the x-ray tube input current dependent on the input voltage to said inverter, thereby maintaining the x-ray tube voltage constant independently of said internal network resistance.

2. An x-ray generator as claimed in claim 1, further comprising:

a low-voltage filter stage connected between said power source and said inverter having a capacitance dimensioned such that said input voltage to said inverter cannot be changed at a rate faster than the x-ray tube current can be changed.

3. A medium frequency x-ray tube generator comprising:

a power rectifier connected to a main power source of unknown internal resistance;

an x-ray tube having a filament;

a low-voltage filter stage, an inverter, a high-voltage transformer and a high-voltage rectifier sequentially between said power rectifier and said x-ray tube supplying said x-ray tube with a tube voltage and a tube current; and a control unit connected to said filament of said x-ray tube and having inputs connected between said low-voltage filter stage and said inverter, said control unit controlling the filament current dependent on the input voltage to said inverter, thereby controlling the tube current so as to maintain the tube voltage constant independently of the internal resistance of said main power source.

4. A medium frequency x-ray tube generator as claimed in claim 3, further comprising a capacitance connected in said low-voltage filter stage dimensioned such that said input voltage to said inverter cannot be changed at a rate faster than said x-ray tube current can be changed.

5. A medium frequency x-ray generator comprising:

an x-ray tube;

means connecting said x-ray tube to a power source having an unknown internal network resistance;

an inverter connected between said means connecting said x-ray tube to a power source and said x-ray tube;

a capacitance connected in parallel between said means connecting said x-ray tube to a power source and said inverter; and a control unit connected to said x-ray tube and having inputs connected between said capacitance and said inverter, said control unit controlling the x-ray tube input current dependent on the input voltage to said inverter so as to maintain the x-ray tube voltage constant independently of the internal resistance of said power source, and said capacitance being dimensioned such that the input voltage to said inverter cannot be changed at a rate faster than the x-ray tube current can be changed.

* * * * *